United States Patent [19]

Deutsch

[11] Patent Number: 4,697,490

[45] Date of Patent: Oct. 6, 1987

[54] MUSICAL TONE GENERATOR USING INCREMENTAL HARMONIC VARIATION

[75] Inventor: Ralph Deutsch, Sherman Oaks, Calif.

[73] Assignee: Kawai Musical Instrument Mfg. Co., Ltd., Hamamatsu, Japan

[21] Appl. No.: 867,999

[22] Filed: May 29, 1986

[51] Int. Cl.[4] ..... G10H 1/06; G10H 7/00

[52] U.S. Cl. ..... 84/1.01; 84/1.11; 84/1.19

[58] Field of Search ..... 84/1.01, 1.11–1.13, 84/1.19–1.27

[56] References Cited

U.S. PATENT DOCUMENTS

| | | | |
|---|---|---|---|
| 4,249,448 | 2/1981 | Deutsch et al. | 84/1.23 |
| 4,273,018 | 6/1981 | Deutsch | 84/1.22 |
| 4,286,491 | 9/1981 | Deutsch | 84/1.01 |
| 4,461,200 | 7/1984 | Kitagawa | 84/1.21 |
| 4,466,325 | 8/1984 | Takauji | 84/1.22 |
| 4,489,637 | 12/1984 | Deutsch | 84/1.22 |
| 4,502,360 | 3/1985 | Deutsch | 84/1.23 |
| 4,549,459 | 10/1985 | Deutsch | 84/1.01 |
| 4,579,032 | 4/1986 | Deutsch | 84/1.22 |

*Primary Examiner*—Stanley J. Witkowski
*Attorney, Agent, or Firm*—Ralph Deutsch

[57] ABSTRACT

A keyboard operated musical instrument is disclosed in which musical tones are created by computing waveshapes from a set of harmonic coefficients. Tones with time variant spectra are obtained by scaling each harmonic coefficient in response to a stored set of scaling numbers. An efficient scaling implementation is described which changes the harmonic coefficients by increments of a predetermined ratio. The tone generation system provides a significant reduction in the number of stored numbers in comparison with a simple stored waveform tone generator.

10 Claims, 6 Drawing Figures

MUSICAL TONE GENERATOR USING INCREMENTAL HARMONIC VARIATION

BACKGROUND OF THE INVENTION

1. Field of the Invention

This invention relates to musical tone synthesis and in particular is concerned with an improvement for producing tones from stored incremental harmonic values.

2. Description of the Prior Art

The most obvious method to imitate an acoustic musical instrument is to record the sound and to replay the recording in response to an actuated keyswitch on an array of keyswitches. While at first thought the straightforward technique of recording and keyed playback seems to be attractive, a practical realization of such a musical instrument can be burdened by a large amount of memory required to store the recorded data. The maximum amount of memory is associated with a tone generation system that uses a separate and distinct recording for each note played in the range of the musical instrument's keyboard. Some economy in the memory requirement has been made by using a single recording for several contiguous musical notes. This economy is based upon the tacit assumption that the waveshape for the imitated musical instrument does not change markedly between several contiguous successive notes.

Electronic musical tone generators that operate by playing back recorded musical waveshapes stored in a binary digital data format have been given the generic name of PCM (Pulse Code Modulation). A musical instrument of the PCM type is described in U.S. Pat. No. 4,383,462 entitled "Electronic Musical Instrument." In the system described in the patent, the complete waveshape of a musical tone is stored for the attack and decay portions of the musical tone. A second memory is used to store the remainder of the tone which comprises the release phase of the musical tone. The sustain phase of the musical tone is obtained by using a third memory which stores only points for a single period of a waveshape. After the end of the decay phase, the data stored in the third memory is read out repetitively and the output data is multiplied by an envelope function generator to create the amplitude variation for the sustain and release portions of the generated musical tone.

Various techniques have been employed to reduce the amount of stored data in a PCM tone generation system. A method of reducing the amount of stored data is described in U.S. Pat. No. 3,763,364 entitled "Apparatus For Storing And Read Out Periodic Waveforms." The disclosed system utilizes the even and/or odd symmetry of a waveform in such a manner that only sample points for one-half of the waveform need be stored in a waveshape memory. When the waveform is read from the waveshape memory, the unstored sample points of the second half of the waveshape period are recreated by using the symmetry property of the stored data points.

A method for reducing the amount of stored data in a PCM musical tone generation system is described in the copending Patent Application No. 827,983 filed Feb. 10, 1986 entitled "Data Reduction For A Musical Instrument Using Stored Waveforms." This referenced application has the same inventor as the present application and they are assigned to the same assignee. In the system described in the referenced copending application a waveshape memory is used to store a number of segments of waveshape data points. Each segment corresponds to one-half of the period of a synthesized waveshape having a waveshape symmetry about the half-wave point and having a spectra equal to that of a corresponding segment of a musical tone recorded from a musical instrument. The missing waveshape points are reconstructed by reading out each segment in a forward and reverse memory order and then jumping to an adjacent segment where the forward and back operation is repeated. A further reduction in the amount of stored data can be obtained by repeating the data read out for a given segment of waveshape memory a predetermined number of cycles before a jump is made to an adjacent segment.

A penalty must usually be paid for a scheme that reduces the number of stored data points in a PCM musical tone generation system. A reduction in the amount of stored data generally is accompanied by an increase in the complexity of the tone generation system. Even with the current low cost of microelectronic memory devices, the large number of stored data points in a simple PCM tone generation system is too large for implementing a low cost keyboard musical instrument. For this reason it is attractive to employ some data processing subsystem logic as a means for reducing the amount of waveshape memory. An object of the present invention is to implement a musical tone generation having the tone capability of a PCM system but system but using only a minimal stored set of data for each of the selectable musical tone colors.

SUMMARY OF THE INVENTION

In a musical instrument of the type in which the musical tone is generated by computing waveforms from a set of harmonic coefficients a large reduction in the amount of stored data is obtained without eliminating the temporal variation of the tone spectrum. A given set of harmonic coefficients is varied by incrementing or decrementing each coefficient by a fixed ratio in response to a scale data word. Each individual bit of the scale data word corresponds to an individual harmonic coefficient. The associated harmonic coefficient is incremented in value by the fixed ratio if its associated scale data word bit is a "1" and it is decremented by a fixed ratio if the associated scale data word bit is a "0".

A nearly constant harmonic coefficient value is obtained by alternating its scale data word bits from "1" to "0".

A provision is made to maintain the harmonic coefficients at a constant value during the sustain portion of the envelope of the generated musical tone.

BRIEF DESCRIPTION OF THE DRAWINGS

The detailed description of the invention is made with reference to the accompanying drawings wherein like numerals designate the components in the figures.

DETAILED DESCRIPTION OF THE INVENTION

The present invention is directed toward a musical tone generator in which a musical waveshape is computed from harmonic data stored in a memory.

Figure 6:
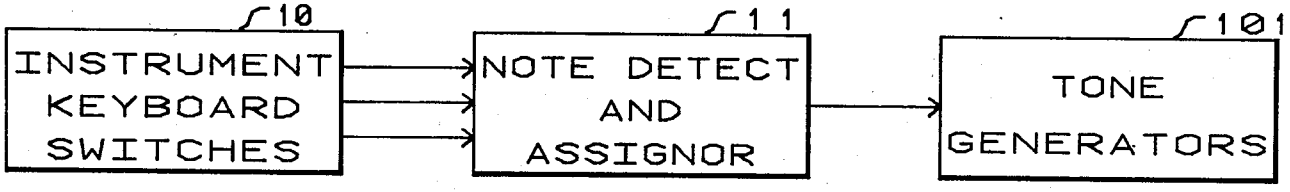
FIG. 6 is a schematic diagram of an embodiment of the invention.

FIG. 6 illustrates an embodiment of the present invention as incorporated into a keyboard operated electronic musical instrument.

Figure 1:
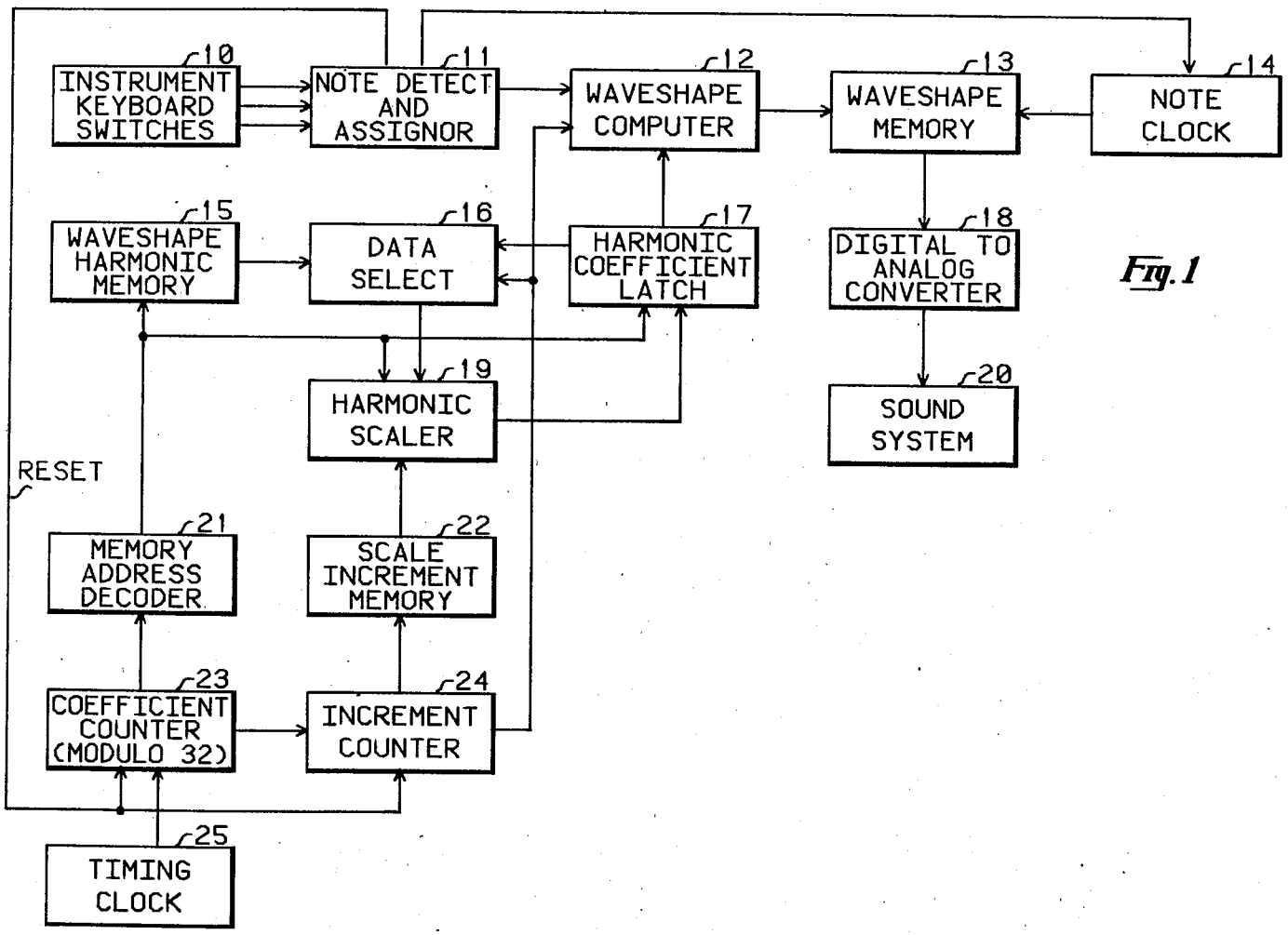
FIG. 1 is a schematic diagram of an embodiment of the invention showing the details of one of the tone generators.

FIG. 1 illustrates an embodiment of the invention showing details of one of the tone generators contained in the system box of FIG. 6 labelled tone generators 101. The keyboard switches are contained in the system logic block labeled instrument keyboard switches 10. If one or more of the keyboard switches has a switch status change is is actuated ("on" switch position), the note detect and assignor 11 encodes the detected keyboard switch having the status change to an actuated state and stores the corresponding note information in a memory which is contained in the note detect and assignor 11. A tone generator is assigned to each actuated keyswitch using the encoded detection information generated by and stored in the note detect and assignor 12.

Only a representative one of a plurality of tone generators, contained in the system block labelled tone generators 101 in FIG. 6, is shown explicitly in FIG. 1. The representative tone generator is comprised of all the illustrated system blocks except for blocks 10 and 11.

A suitable configuration for a note detect and assignor subsystem is described in U.S. Pat. No. 4,022,098 entitled "Keyboard Switch Detect And Assignor." This patent is hereby incorporated by reference.

When a keyboard switch has been detected to have been actuated by the not detect and assignor 11, a RESET signal is generated. The RESET signal is used to reset both the coefficient counter 23 and the increment counter to their minimal, or binary zero, count state.

The coefficient counter 23 counts the timing signals generated by the timing clock 25. This counter is implemented to count modulo 32. The modulo 32 number is selected to correspond to the maximum number of harmonics in the spectra of the tones created by the tone generator. The illustrative number 32 is not a limitation or restriction of the invention and can readily be changed to any desired number. Such an extension is evident from the detailed description of the operation of the invention system.

Each time that the coefficient counter 23 returns to its minimal count because of its modulo counting implementation, a signal is generated which is used to increment the count state of the increment counter 24.

The memory address decoder 21 reads out data from both the waveshape harmonic memory 15 and the harmonic coefficient latch 17 in response to the count state of the coefficient counter 23.

The waveshape harmonic memory 15 is used to store a set of 32 harmonic coefficients. These harmonic coefficients are used to compute a waveshape segment for the first portion of the attack phase of the musical tone which is generated in response to the actuation of a keyboard switch.

When the increment counter 24 is in its minimal (zero binary value) count state, the data select 16 will transfer harmonic coefficients read out from the waveshape harmonic memory 15 to the harmonic scaler 19. For all other count states of the increment counter 24, the data select 16 will transfer harmonic coefficients read out from the harmonic coefficient latch 17 to the harmonic scaler 19.

Figure 2:
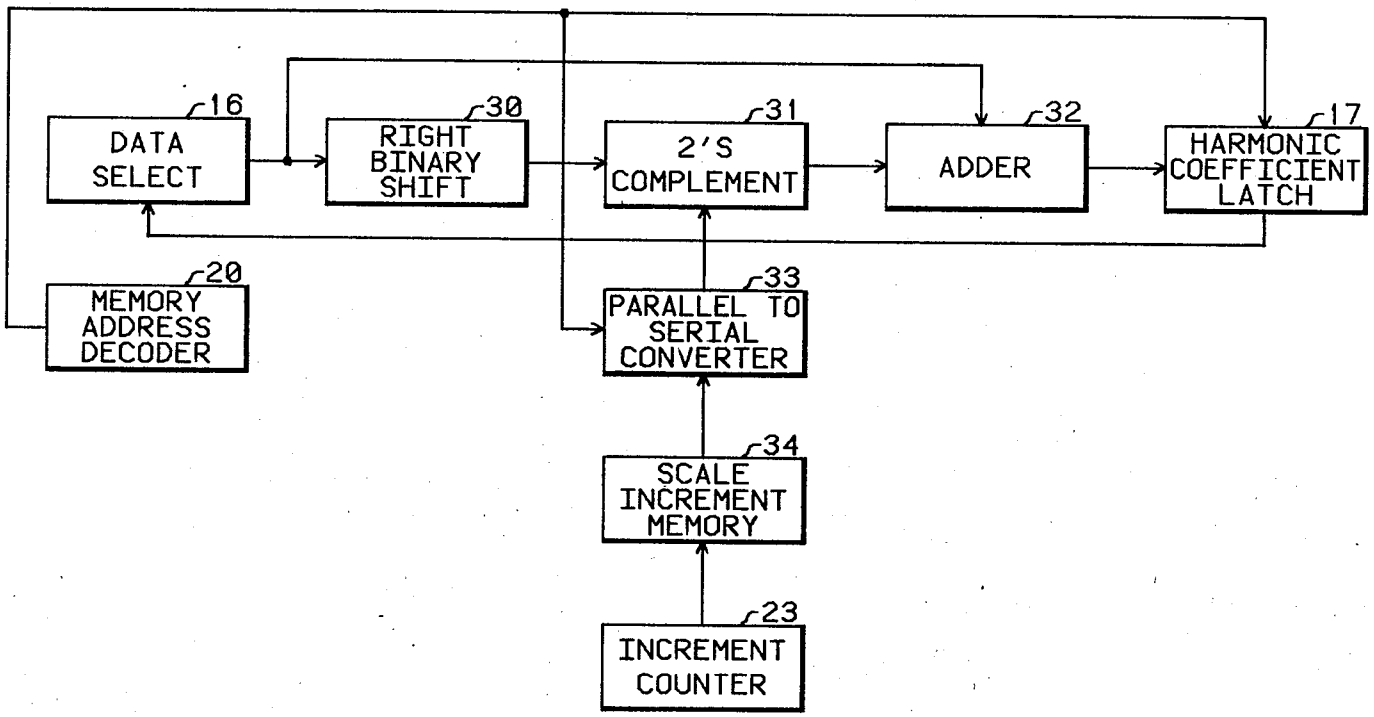
FIG. 2 is a schematic diagram of the harmonic scaler 19.

The scale increment memory 22 is used to store a number of scale data words. A selected scale data word is read out from the scale increment memory 22 in response to the count state of the increment counter 24. A scale data word comprises a set of bits each of which determine if a corresponding harmonic coefficient transferred by the data select 16 is to be incremented or decremented by means of the harmonic scaler 19. The details of the harmonic scaler 19 are shown in FIG. 2 and are described below.

The new, or scaled, values of the harmonic coefficients produced by the harmonic scaler 19 are stored in the harmonic coefficient latch 17 at a memory location determined by the output from the memory address decoder 21.

Each time that the increment counter 24 is incremented, the waveshape computer 12 transfers the harmonic coefficients stored in the harmonic coefficient latch 17 into an internal memory contained in the waveshape computer 12. The waveshape computer 12 computes a waveshape using its internally stored set of harmonic coefficients. The computed waveshape is stored in the waveshape memory 13.

The note clock 14 reads out the waveshape data points stored in the waveshape memory at a memory advance rate which corresponds to the frequency associated with the actuated keyboard switch to which the tone generator has been assigned. The memory advance rate generated by the note clock 14 is controlled by the encoded keyswitch detect data obtained by and stored internally in the note detect and assignor 11.

The waveshape data points read out from the waveshape memory 13 are converted into an analog signal by means of the digital-to-analog converter 18. The analog signal is converted into an audible musical sound by means of the sound system 20. The sound system 20 consists of a conventional amplifier and speaker combination.

FIG. 2 illustrates an implementation of the harmonic scaler 19. In this implementation of the harmonic scaler 19, a zero bit in a position of the scale data word read out from the scale increment memory 34 indicates that the corresponding harmonic coefficient is to be decreased by a prespecified number of db while 1 bit indicates that the corresponding harmonic coefficient is to be increased by the same prespecified number of db.

The scale data word read out from the scale increment memory in a parallel binary word format is converted into a serial format by means of the parallel to serial converter 33. The least significant bit of the converted word is the first bit in the serial data format. Each bit of the serial form of the scale data word is supplied to the 2's complement 31 in response to the data supplied by the memory address decoder 20.

The harmonic coefficient data value transferred by the data select 16 is right shifted by k-bits by means of the right binary shift 30. If the corresponding scale data word bit provided by the parallel to serial converter 33 is a "0" binary value, then the 2's complement 31 performs a 2's complement binary operation on the input data and the result is provided as one input to the adder 32. The adder 32 sums the output value from the 2's complement 31 with the original harmonic coefficient transferred by the data select 16. If the corresponding scale data word bit is a "1", then the 2's complement 31 transfers the output from the right binary shift 30 unaltered to the adder 32.

The output modified harmonic coefficient produced by the adder 32 is stored in the harmonic coefficient latch at a memory location corresponding to the output of the memory address decoder 20.

Because only two binary states are possible for each bit of the scale data word, special attention must be given to intervals during which a harmonic coefficient should remain at an essentially constant value. To maintain an almost constant value, the corresponding bit of the scale data word for such a harmonic coefficient is made to alternate between a "0" and a "1" state for the same bit position for consecutive scale data word bits during a segment of the generated musical waveshape for which a specified harmonic coefficient is to be maintained at a nearly constant value.

While it is not strictly true that the alternation of a "0" and "1" input for a given bit position at the input to the 2's complement 31 will average the db change in a selected harmonic coefficient to a zero value, it is almost true for moderate changes in the db value as determined by the number of bits a harmonic coefficient is shifted by the right binary shift 30. The db change in a harmonic coefficient at the output of the adder 32 can be written as $$db = 20 \log_{10} A(1 \pm 2^{-k}) \qquad \text{Eq. 1}$$

where A is the magnitude of the harmonic coefficient and k is the number of bits of the harmonic coefficient that are shifted by the right binary shift 30. The plus and minus signs denote the two possible actions taken by the 2's complement 31 in response to a "1" or "0" bit introduced by a scale data word. Because the value of $2^{-k}$ is less than unity, the expression in Eq. 1 can be approximated by the series $$db = 20/2.3026(\pm 2^{-k} + 2^{-2k} \pm 2^{-3k/3} + \ldots) + 20 \log_{10} A \qquad \text{Eq. 2}$$

It is the second term in the series that represents the error in a non-zero average value when alternating "0" and "1" inputs are presented to the 2's complement 31 by a succesion of scale data words.

The error in maintaining a constant value by alternating bit states can be made relatively small by suitable choices of the shift index k. For example a right shift of k=3 corresponds to an increase of 1.0231 db if a "0" is the input to the 2's complement 31. The same value of k=3 corresponds to a decrease of −1.1560 db if a "1" is the input to the 2's complement 31. Alternating a "0" and "1" bit value to the 2's complement 31 produces an average value change of 0.14 db which is of little consequence in most cases. A large value of k, such as k=4, will even further reduce the drift in the average zero value.

The waveshape computer 12 can be implemented as any subsystem which implements a Fourier-type transform algorithm to compute a set of waveshape points from a given set of harmonic coefficients. One such waveshape generator is described in U.S. Pat. No. 3,809,786 entitled "Computer Organ." This patent is hereby incorporated by reference. Another waveshape generator that can be used to implement the waveshape computer 12 is described in U.S. Pat. No. 4,085,644 entitled "Polyphonic Tone Synthesizer." This patent is also hereby incorporated by reference.

The present inventive system attains an economy in memory requirement because only a single data word with a length of 32 bits is required for each different waveshape period. For the basic simple digital recording technique for a PCM musical tone generator a minimum total of 64 words each with a 12 bit word length is required for an equivalent waveform having the same number of 32 maximum harmonics. This is a total of 64×12=768 bits of memory for each waveshape period. Therefore, for this illustrative example, the present inventive system offers a reduction in the basic tone determining memory of 768/32=24.

The waveshape memory 13, shown in FIG. 1, is used as a temporary storage for systems in which the waveshape computer 12 does not operate fast enough to produce waveshapes in real time. Such a system using a buffer memory is described in the previously referenced U.S. Pat. No. 4,085,644. If the waveshape computer 12 is implemented to operate in "real time" then the waveshape memory 13 and note clock 14 can be eliminated.

With the exception of the system logic blocks in FIG. 1 numbered 10, 11, 20 and 25 the remainder of the blocks constitute a single tone generator. Other tone generators are implemented by duplicating the system blocks shown in FIG. 1.

Figure 3:
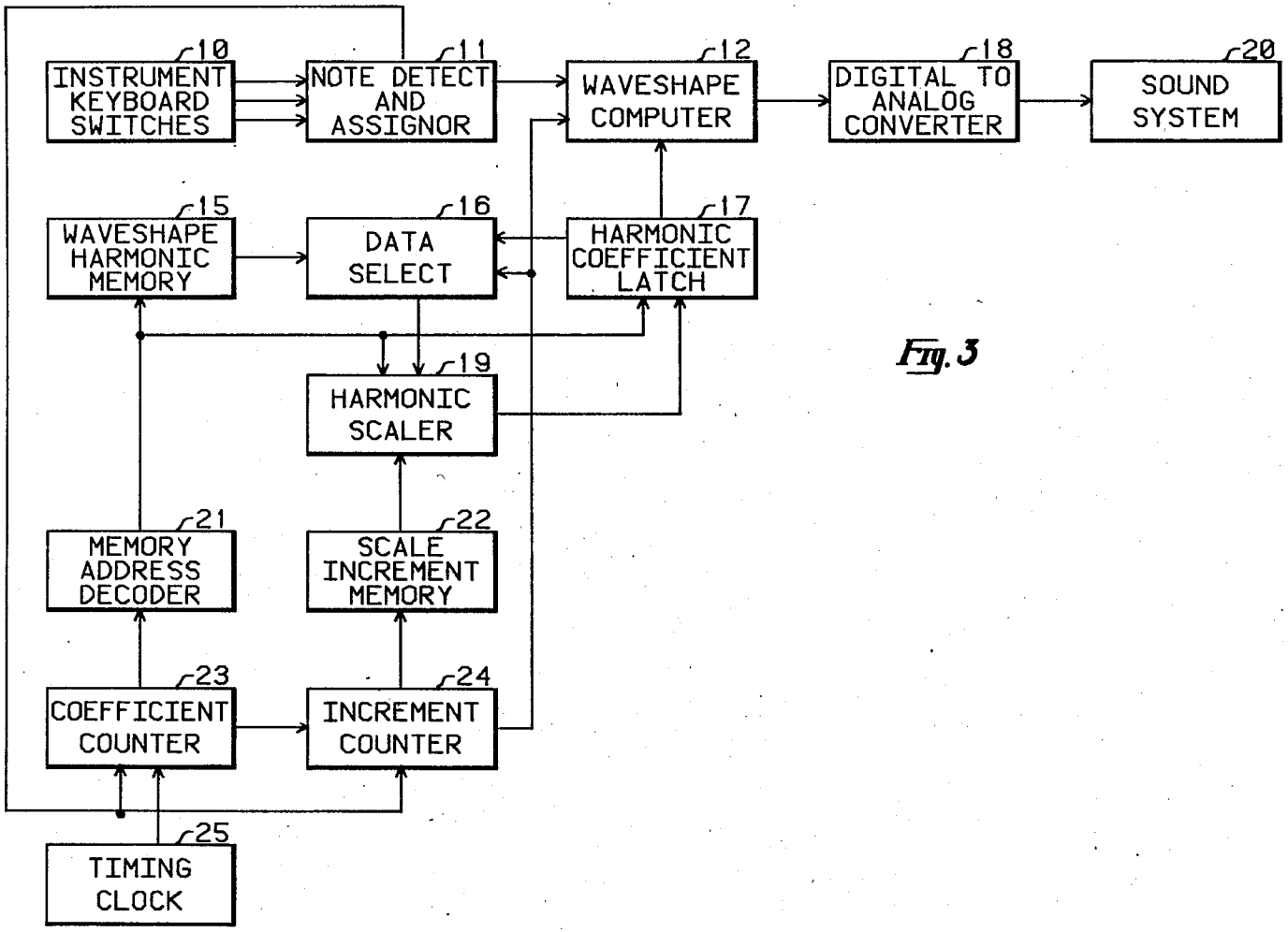
FIG. 3 is a schematic diagram of an alternate embodiment of the invention.
Figure 4:
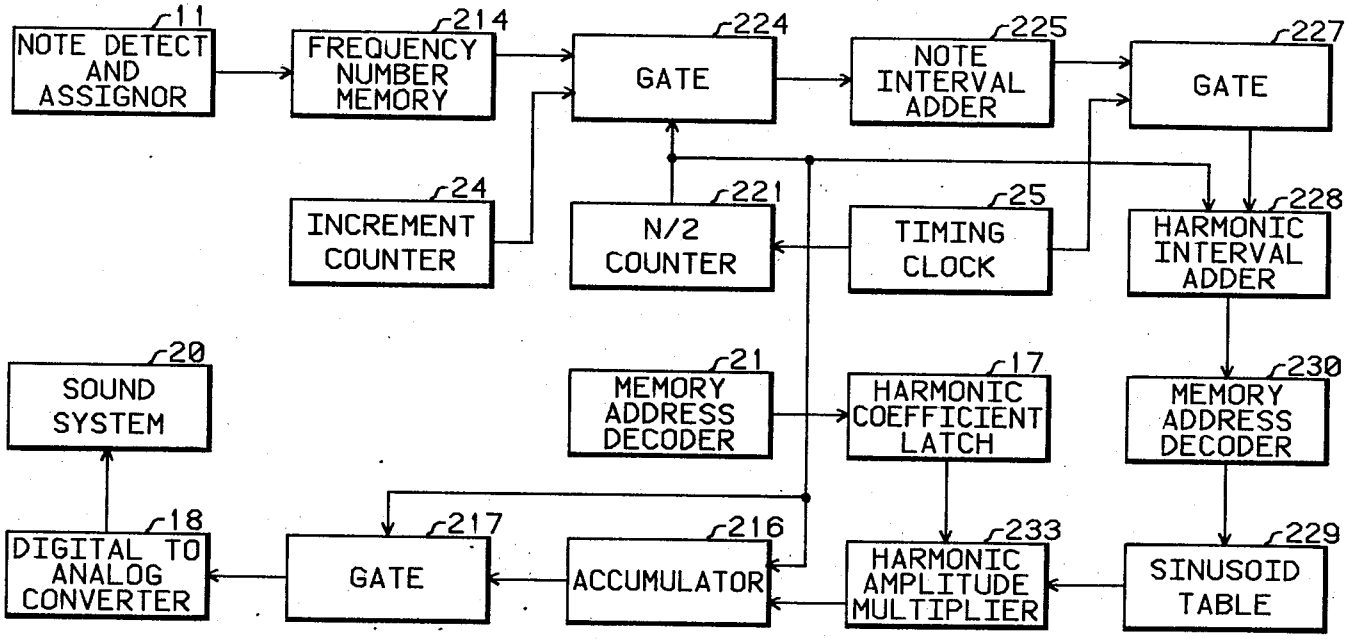
FIG. 4 is a schematic drawing of the waveshape computer 12.

FIG. 3 illustrates an alternate configuration for the present invention in which the waveshape computer 12 operates at a sufficiently fast speed so that the waveshape memory 13 can be eliminated. The details of the waveshape computer are shown in FIG. 4 and are described in the referenced U.S. Pat. No. 3,809,786.

The system blocks in FIG. 4 having a number in the 200 range correspond to 200 added to the system block numbers shown in FIG. 1 of the referenced U.S. Pat. No. 3,809,786.

In response to the encoded keyswitch closure data produced by the note detect and assignor 11 a corresponding frequency number is read out from the frequency number memory 214. The frequency number memory 214 can be implemented as a read-only addressable memory (ROM) containing data words stored in binary numeric format having values $2^{(N-M)/12}$ where N has the range of values N=1,2, . . . ,M and M is equal to the number of keyswitches on the musical instrument's keyboard. N designates the number of a keyswitch. These keyswitches are numbered consecutively from "1" at the keyboard switch corresponding to the lowest musical tone frequency produced by the musical instrument. The frequency numbers represent the ratios of frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

The note interval adder 225 successively adds the frequency number transferred by the gate 224 to an accumulator to produce an accumulated frequency number.

The accumulated frequency number specifies the sample point at which a waveshape amplitude is calculated. For each sample point, the amplitudes of 32 harmonic components are calculated by individually multiplying harmonic coefficients read out of the harmonic coefficient latch 17 by trigonometric sinusoid values read out from the sinusoid table 229.

The harmonic interval adder 228 is initialized by a signal provided by the N/2 counter 321. In response to timing signals generated by the clock 220, the harmonic interval adder 228 successively adds the content of the note interval adder 225 to the content of an accumulator contained in the harmonic interval adder 228. The memory address decoder 230 reads out a trigonometric sinusoid function value from the sinusoid table 230 in response to the content of the accumulator in the harmonic interval adder 228.

The harmonic component amplitudes produced by the harmonic amplitude multiplier 233 are summed algebraically in the accumulator 216 to obtain the net amplitude at a waveshape sample point. The sample point amplitudes are converted into an analog signal by means of the digital-to-analog converter 18 and the analog signal is furnished to the sound system 20.

Figure 5:
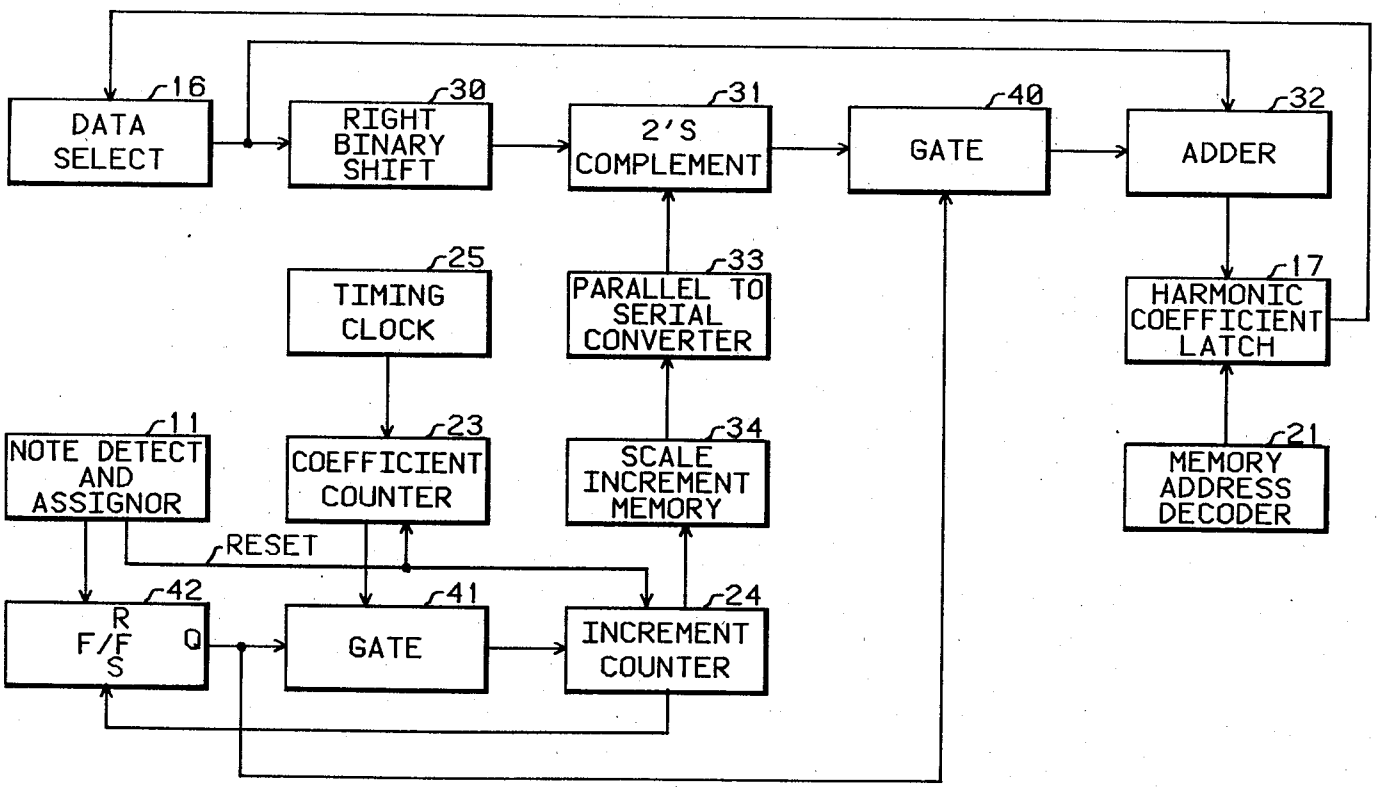
FIG. 5 is a schematic diagram of a second alternate embodiment of the invention.

FIG. 5 illustrates an alternative embodiment of the present invention. In this embodiment the waveshape during the sustain phase of the musical tone is maintained at constant predetermined waveshape. This constant waveshape is maintained starting at the end of the decay phase until the release phase is initiated corresponding to the release of the keyswitch to which the tone generator has been assigned.

When the note detect and assignor 11 detects the presence of a newly actuated keyboard switch, a signal is generated which is used to reset the flip-flop 42 so that its output Q is placed in a logic "0" state.

In response to the signal Q="0", the gate 41 transmits the reset signals generated by the coefficient counter 23 to the increment counter 24.

At a predetermined count of the increment counter, a signal is generated which is used to set the flip-flop 42 so that its output binary logic state is Q="1". This count is preselected such that the generated musical tone has completed both its attack and decay phases.

In response to the signal state Q="1", the gate 41 and the gate 40 inhibit the transfer of their input data signals. This in effect "freezes" the waveshape to a constant shape because the data stored in the harmonic coefficient latch 17 cannot change if the gate 40 does not provide any input to the adder 32.

When the keyswitch to which the tone generator is assigned is released, the note detect and assignor 11 again generates a signal which resets the flip-flop 42 so that its output logic signal state is Q="0". This state permits the data for the release phase of the musical tone to be read out of the scale increment memory 34. In this fashion a time variable waveshape is generated during this final phase of the generated musical tone.

I claim

1. In combination with a keyboard operated musical instrument having an array of keyswitches, apparatus for producing musical tones having time variant spectral components comprising;

an assignor means whereby a detect data word is generated in response to each actuated keyswitch in said array of keyswitches and one of a plurality of tone generators is assigned to each actuated keyswitch and whereby a corresponding detect data word is provided to the corresponding said assigned tone generator; and said plurality of tone generators each of which comprises, a first memory means for storing a preselected set of harmonic coefficients, a second memory means for storing harmonic coefficients, a memory address decoding means for simultaneously reading out harmonic coefficients stored in said first memory means and harmonic coefficients stored in said second memory means, a third memory means for storing scaling constants, a scaling addressing means for reading out scaling constants from said third memory means, a data select means whereby said harmonic coefficients read out from said first memory means are selected in response to a select signal and whereby said harmonic coefficients read out from said second memory means are selected if said select signal is not present, a scaling means whereby said harmonic coefficients selected by said data select means are scaled in magnitude in resposne to said scaling constants read out from said third memory means to form a set of scaled harmonic coefficients and whereby said scaled harmonic coefficients are stored in said second memory means, a means for computing whereby a set of data points is computed in response to said scaled harmonic coefficients stored in said second memory means, and a conversion means for producing a musical tone responsive to said data points computed by said means for computing.

2. In a musical instrument according to claim 1 wherein said memory address decoding means comprises;

a timing clock for providing timing signals, a first counter for counting said timing signals modulo the number of harmonic coefficients in said preselected set of harmonic coefficients stored in said first memory means wherein a zero signal is generated each time the count state of said first counter is incremented to its minimal count state, and a first memory reading means for reading out harmonic coefficients from said first memory means in response to the count state of said first counter and for reading out scaled harmonic coefficients from said second memory means in response to the count state of said first counter.

3. In a musical instrument according to claim 2 wherein said scaling addressing means comprises;

an instrument counter for counting each said zero signal, a select signal generator whereby said select signal is generated in response to said detect signal, and a second memory reading means for reading out scaling constants from said third memory means in response to the count state of said increment counter.

4. In a musical instrument according to claim 3 wherein said scaling means comprises;

a binary shift means whereby harmonic coefficients selected by said data select means are right shifted a predetermined number of binary bits, a parallel to serial conversion means whereby the scaling constants read out from said third memory means are converted into a binary scaling constant in a binary serial format, a 2's complement means whereby in response to a prespecified bit of said binary scaling constant in a binary serial format having a "one" value a binary shifted harmonic coefficient formed by said shift means is converted into its 2's complement binary data format and whereby in response to said prespecified bit of said binary scaling constant having a "zero" value said binary shifted harmonic coefficient is not converted into its 2's complement binary data format, and an adder means for summing each said harmonic coefficient selected by said data select means with a corresponding binary shifted harmonic coefficient produced by said 2's complement means and whereby each summation result is stored in said third memory means.

5. In a musical instrument according to claim 1 wherein said assignor means comprises;

a keyswitch state detect means wherein a detect signal is generated in response to each actuated keyswitch in said array of keyswitches, and an encoding means for encoding each said detect signal to generate said corresponding data detect word which identifies each said actuated keyswitch corresponding to a generated detect signal.

6. In combination with a keyboard operated musical instrument having an array of keyswitches, apparatus for producing a musical tone having time variant spectral components comprising;

an assignor means whereby a detect data word is generated in response to each actuated keyswitch in said array of keyswitches and one of a plurality of tone generators is assigned to each actuated keyswitch and whereby a corresponding detect data word is provided to the corresponding said assigned tone generator; and said plurality of tone generators each of which comprises, a first memory means for storing a preselected set of harmonic coefficients, a second memory means for storing harmonic coefficients, a memory address decoding means for simultaneously reading out harmonic coefficients stored in said first memory means and harmonic coefficients stored in said second memory means, a third memory means for storing scaling constants, a scaling addressing means for reading out scaling constants from said third memory means, a select signal generator whereby a select signal is generated in response to said data word provided to said assigned tone generator, a data select means whereby said harmonic coefficients read out from said first memory means are selected in response to said select signal and whereby said harmonic coefficients read out from said second memory means are selected if said select signal is not present, an inhibit signal generating means whereby an inhibit signal is generated at a prespecified time interval following the generation of said detect word, a scaling means responsive to said inhibit signal whereby said harmonic coefficients selected by said data select means are transferred unaltered and whereby if said inhibit signal is not generated said harmonic coefficients selected by said data select means are scaled in magnitude in response to said scaling constants read out from said third memory means to form a set of scaled harmonic coefficients which are then transferred, storage addressing means whereby said scaled harmonic coefficients transferred by said scaling means are stored in said second memory means, and a means for computing whereby a set of data points is computed in response to said scaled harmonic coefficients stored in said second memory means, and a means for producing a musical tone responsive to said data points computed by said means for computing.

7. In a musical instrument according to claim 6 wherein said memory addressing decoding means comprises, a timing clock for providing timing signals, a first counter for counting said timing signals modulo the number of harmonic coefficients in said preselected set of harmonic coefficients stored in said first memory means wherein a zero signal is generated each time the count state of said first counter is incremented to its minimal count state, a first memory reading means for reading out harmonic coefficients from said first memory means in response to the count state of said first counter, and a first memory reading means for reading out harmonic coefficients from said first memory means in response to the count state of said first counter and for reading out scaled harmonic coefficients from said second memory means in response to the count state of said first counter.

8. In a musical instrument according to claim 7 wherein said scaling addressing means comprises;

an increment counter whose count state is incremented by said zero signal, a gate means interposed between said first counter and said increment counter whereby said zero signal is not furnished to said increment counter if an inhibit signal is furnished to said gate means, a second memory reading means for reading out scaling constants from said third memory means in response to the count state of said increment counter.

9. In a musical instrument according to claim 8 wherein said increment counter comprises;

an inhibit signal generator wherein said inhibit signal is generated when the count state of said increment counter is larger than a prespecified number and wherein said inhibit signal is not generated when said detect data word is not generated by said assignor means.

10. In a musical instrument according to claim 6 wherein said assignor means comprises;

a keyswitch state detect means wherein a detect signal is generated in response to each actuated keyswitch in said array of keyswitches, and an encoding means for encoding each said detect signal to generate said corresponding data detect word which identifies each said actuated keyswitch corresponding to a generated detect signal.

* * * * *